US006041567A

United States Patent [19]

Passeno

[11] Patent Number: 6,041,567

[45] Date of Patent: Mar. 28, 2000

[54] FORMLINER FOR DECORATIVE WALL

[76] Inventor: James Kenneth Passeno, 116 W. State, Grant, Mich. 49327

[21] Appl. No.: 08/744,105

[22] Filed: Nov. 5, 1996

[51] Int. Cl.[7] ..... E04G 11/06; E04G 21/18; E04G 21/22

[52] U.S. Cl. ..... 52/749.11; 52/384; 52/387; 52/389; 52/749.13; 52/311.3; 52/315; 249/96; 33/518

[58] Field of Search ..... 52/384, 386, 387, 52/389, 749.11, 749.13, 127.3, 311.3, 315; 249/16, 91, 96, 15; 33/518

[56] References Cited

U.S. PATENT DOCUMENTS

| | | | |
|---|---|---|---|
| 573,127 | 12/1896 | Balph et al. . | |
| 2,178,535 | 10/1939 | Wilson | 249/15 X |
| 2,465,871 | 3/1949 | Hardie et al. . | |
| 2,550,194 | 4/1951 | Jackson . | |
| 2,613,423 | 10/1952 | Davis . | |
| 2,618,815 | 11/1952 | Iezzi . | |
| 3,231,646 | 1/1966 | Condor et al. | 249/96 X |
| 3,426,490 | 2/1969 | Taylor . | |
| 3,602,476 | 8/1971 | Iragorri . | |
| 4,453,359 | 6/1984 | Robinson | 52/389 |
| 5,009,387 | 4/1991 | Scott et al. | 249/16 X |
| 5,061,161 | 10/1991 | Tetu . | |
| 5,268,137 | 12/1993 | Scott et al. | 249/96 X |

FOREIGN PATENT DOCUMENTS

| | | | |
|---|---|---|---|
| 2803389 | 8/1978 | Germany | 52/315 |
| 2839704 | 3/1980 | Germany | 52/315 |
| 53-28923 | 3/1978 | Japan | 52/389 |

*Primary Examiner*—Carl D. Friedman
*Assistant Examiner*—Laura A. Callo
*Attorney, Agent, or Firm*—Vanophem Meehan & Vanophem, P.C.

[57] ABSTRACT

A formliner for use in manufacturing a decorative panel made up of a layer of concrete or other cementitious material interconnecting a layer of spaced apart bricks or other decorative elements, secured in the cementitious material. The formliner is made of a resilient elastomeric material and has a generally planar layer with a plurality of upstanding laterally and transversely extending ribs that extend from the generally planar layer to define a plurality of brick receiving recesses. Each brick is received in a respective recess with its front face positioned toward the generally planar layer. The ribs extend partly up the sides of the brick from the generally planar layer to allow cementitious material to partly fill the spaces between the sides of the bricks. Cementitious material is prevented from reaching the front faces of the bricks within the recesses by a plurality of ridges that extend from the ribs to sealingly engage an adjacent surface of the brick within the recess. The generally planar layer of the formliner is provided with a plurality of upstanding pads within each recess to support a brick within the recess above the major surface of the generally planar layer, and to define a pocket between the surface of the generally planar layer and the front face of the brick. The pocket serves to accumulate any cementitious material that flows past the ridges preventing such cementitious material from settling on the front face of the brick within the recess.

6 Claims, 2 Drawing Sheets

FORMLINER FOR DECORATIVE WALL

BACKGROUND OF THE INVENTION

1. Field of the Invention

This invention relates to a formliner for use in making a wall having a decorative facing. More particularly, this invention relates to a formliner for use in making a cement baked facing having a multiplicity of bricks arranged as in a brick wall with a concrete backing interlocked with the bricks of the facing.

2. Description of the Prior Art

Over the years various methods have been proposed to texture or provide a surface finish to the outer surface of a wall to provide an aesthetically and architecturally pleasing appearance. As a result of these proposals, a number of different arrangements to adhere or embed articles or texture in or on the surface finish of concrete structures have been tried with varying degrees of success. Different methods have been attempted to hold bricks and other objects in a form, usually horizontally while the concrete is poured over the object so as to embed and hold the objects in the surface of the concrete panel. The panel is then used to form the wall, such as by attaching it to an existing structural surface or using that panel as a surface treatment in a new wall structure. Various problems have been associated with such arrangement, the most common being the improper sealing of the brick in the formliner resulting in migration of the concrete along the front faces of the bricks, which spoils the appearance of the panel and, therefore, renders the panel practically unusable.

One method of attempting to solve this problem is taught by Iragorri, U.S. Pat. No. 3,602,476. Iragorri discloses a brick-faced masonry or concrete wall, and discloses a form, described as a template and formed from an elastomeric material, in which bricks are disposed in spaced apart recesses of the form, which are defined by ridges that extend partly into the spaces between bricks, with the front faces of the brick facing the interior of the template. The ridges are undercut so that the openings of each recess are slightly smaller than the nominal dimensions of each brick. Concrete is then poured in a form having the template at the bottom thereof against the rear surfaces of the bricks, to bind to the rear surfaces of the bricks and to fill the spaces between adjacent bricks partly to the front faces of the bricks.

Problems are encountered in manufacturing brick-faced masonary walls in this manner due to the tendency of the concrete to flow completely through the recesses between the bricks and the ridges to the front faces of the bricks. The above results in a mar in the appearance of the bricks due to cured concrete on the front face of the bricks. Thus, it is necessary to manually chip, scrape or brush away the cured concrete from the bricks, which is a laborious and expensive undertaking.

Various methods have been proposed in the prior art to hold bricks in a form, usually horizontally, while the concrete is poured over the bricks so as the embed and hold the bricks in the surface of the concrete panel without the migration of the concrete through the seal and along the front face of the brick. For example, Scott et al, U.S. Pat. No. 5,268,137, utilizes a mold wherein a liquid elastomeric material is poured into the mold containing the bricks positioned in the recesses in the mold to cover the bricks. Reinforcing fiberglass mesh is embedded in the elastomeric material to provide additional tensile strength to the liner. Upon curing, the retained bricks and liner are removed from the mold and the liner is thereafter used in concrete construction by attaching the liner to the inside surface of concrete molds and the bricks are thereby held rigidly in place while the concrete is poured and set. Upon removal of the formliner, the bricks remain permanently embedded in the surface of the concrete structure providing an improved aesthetic appearance. Because of the gasketing effect that is obtained by embedding the outer surface of the bricks in the elastomeric material, the necessity for cleaning and repairing the surface in the finished wall is eliminated. The above problems have plagued decorative wall manufacturing for a significant period of time. The present invention solves this long standing problem.

SUMMARY OF THE INVENTION

According to the present invention, there is provided an improved formliner for use in the manufacture of a wall or other panel, made of bricks or similar elements connected by a cementitious material such as concrete, and having a decorative facing. The formliner of the present invention is preferably manufactured from an elastomeric material and is provided with a plurality of brick or element receiving recesses defined by serrated ridges or ridges with protrusions extending partly from the interior of the formliner into the spaces between the bricks. The ridges have outwardly projecting protrusions to accommodate the irregularities of the bricks and thereby establish an interference fit to positively seal the space between each ridge and the adjacent brick. The seal prevents concrete from flowing into the recesses between adjacent bricks. A further seal is provided which completely surrounds the outline of the front face of the brick by recessing the formliner along the front face of the brick maintaining a narrow ridge of contact between the brick and the formliner along the edges thereof. This face seal along the edge of the brick completely prevents any flow of concrete that may possibly flow into the spaces between the bricks due to the irregularities of the brick from marring the external appearance of the front face of the brick and the associated decorative panel. Further, each recess in the bottom surface of the liner is provided with a plurality of upstanding pads, for engaging the front face of a brick placed therein, to support the brick at a level above the level of a major planar surface of the formliner. Thus, any concrete which possibly could flow past the seals flows into the recess and will be collected at a level below the front face of the brick thereby preventing concrete material from collecting on the front surface of the brick which would be visually detectable and unacceptable.

Accordingly, it is an object of the present invention to provide an improved formliner for use in the manufacture of a wall or other panel of elements held together by a cementitious material to provide a decorative facing.

More particularly, it is an object of the present invention to provide a formliner of the foregoing character with improved effectiveness of the seals to prevent cementitious material from collecting on an exposed surface of the decorative facing which would be visually detectable.

Even more particularly, it is an object of the present invention to provide a formliner of the foregoing character that is useful in the manufacture of a concrete wall or panel having an appearance of a plurality of spaced apart bricks.

A further object of the present invention is to provide for a visual inspection of whether the brick is properly seated in the mold liner by aligning the top surface of the ridges with the bottom surface of the dovetail in the brick.

It is a further object of the present invention to relieve the formliner along substantially a major portion of the front face of the brick thereby effecting a seal along the edges of the brick and to utilize a plurality of pads or buttons strategically placed within the recess of the formliner, along the front face of the brick to prevent excessive deflection of the brick when the brick is placed into the mold and it is either walked upon or the force of the concrete weight as it is poured into the mold causes deflection of the brick resulting in breakage thereof.

It is a further object of the present invention to provide a facing brick intended to be used in conjunction with a formliner to build a decorative wall which encompasses interlocking retention features along its width or length which permits the thickness of the brick to be increased thereby having a greater surface area retained within the concrete yet the weight of the brick is identical to that of the prior art.

For a further understanding of the present invention and the objects thereof, attention is directed to the drawings and the following brief description thereof, to the detailed description of the preferred embodiment and to the appended claims.

DETAILED DESCRIPTION OF THE PREFERRED EMBODIMENT

Figure 1:
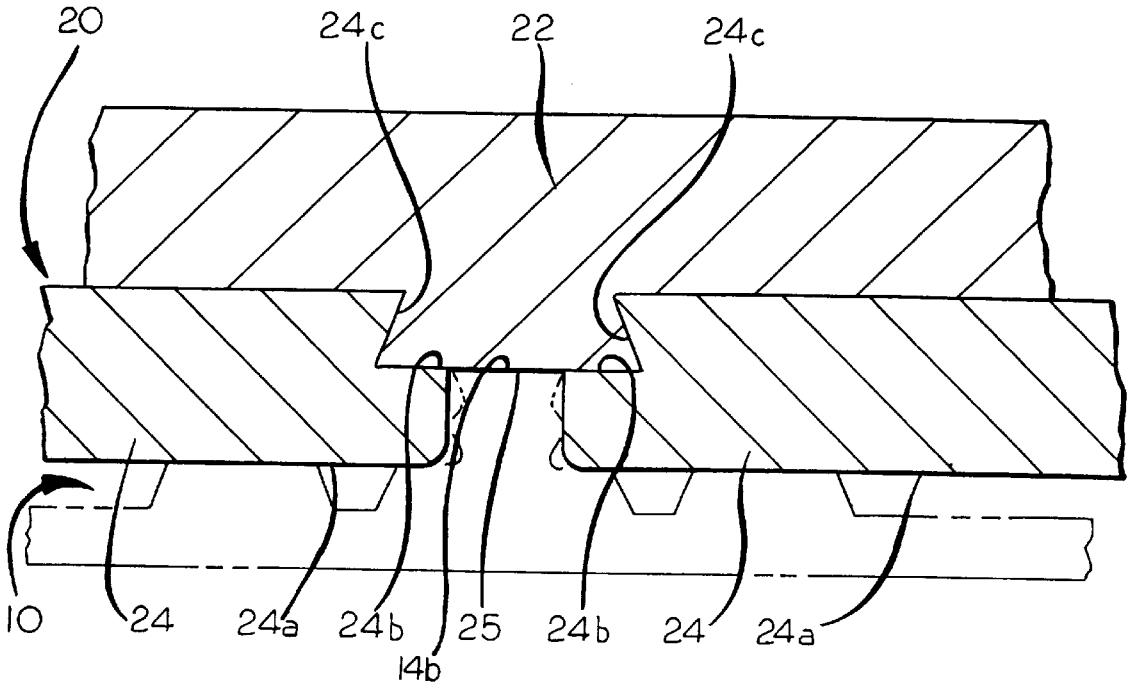
FIG. 1 is a fragmentary, sectional view of a decorative wall manufactured using a formliner according to the preferred embodiment of the present invention.
Figure 2:
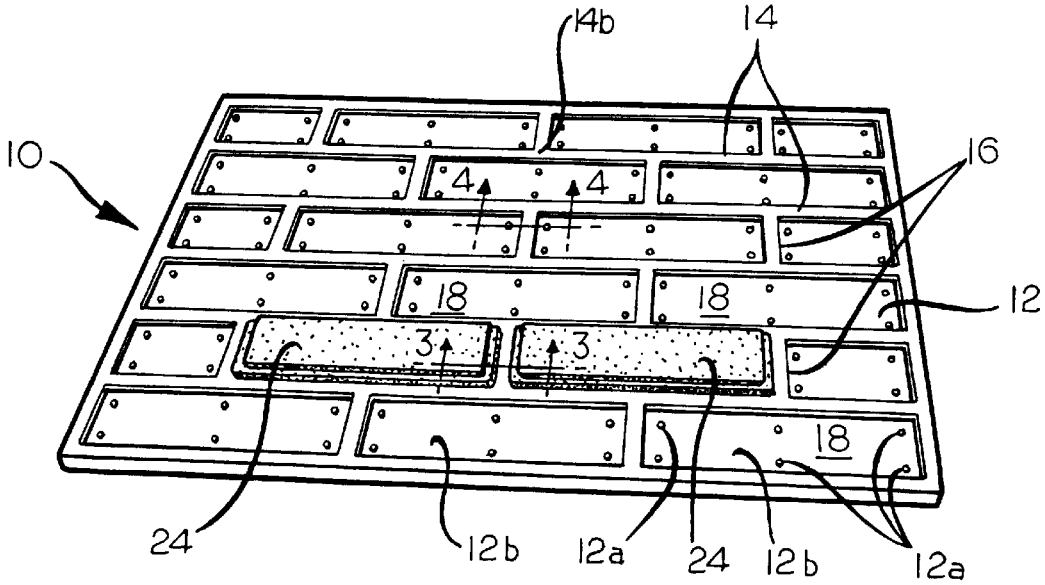
FIG. 2 is a perspective view of a formliner according to the preferred embodiment of the present invention for use in the manufacture of decorative walls, such as the decorative wall of FIG. 1, FIG. 2 illustrating the formliner after a pair of bricks have been placed therein as part of the process for manufacturing the decorative wall of FIG. 1.

A formliner according to the preferred embodiment of the present invention is indicated generally by reference numeral 10 in FIG. 1. The formliner 10 is useful in manufacturing a decorative wall, which is indicated generally by reference number 20 in FIG. 1. The decorative wall 20 is made up of a layer of concrete or other cementitious material 22 including a plurality of spaced apart bricks or other decorative elements 24 embedded in the cementitious material 22. The cementitious material 22 extends partly between and toward the front faces 24*a* of the bricks 24. Each brick 24 is preferably provided with either a laterally or transversely extending undercut dovetail edge 24*c* which receives cementitious material 22 therein to provide good bonding and retention of the bricks 24 in the decorative wall 20.

While the present invention is described using a rectangular brick 24, it should be understood that the present invention works with any shape or size of brick 24 or other element to be assembled into the decorative wall 20.

In the manufacture of the decorative wall 20, it is important that the cementitious material 22 not migrate between bricks 24 all the way to the front faces 24*a* of the bricks 24, where it can set and mar the external appearance of the bricks 24 necessitating expensive repair and replacement of the bricks whose front faces exhibit evidence of migrated cementitious material. To prevent such event, it is intended that cementitious material 22 not flow past an upper surface 14*b* of a lateral rib 14 or transverse rib 16 between adjacent bricks 24 outwardly to the front faces 24*a* of the bricks 24. The upper surface 14*b* is determined by the design of the formliner 10 in combination with the type of face brick to be used in the liner. Any cementitious material on or near the front faces 24*a* of the bricks 24 must be manually chipped away from the bricks 24 if the external appearance of the decorative wall is to be suitable and, as stated above, such manual removal of cementitious material is a laborious and an expensive procedure.

The upper surface 14*b* of the lateral rib 14 or transverse rib 16 also serves a further function of allowing a quick visual inspection of whether the brick is properly seated in the mold liner. The brick is properly seated in the formliner when the upper surface 14*b* of the rib 14 or rib 16 is completely flush with a bottom surface 24*b* of adjoining bricks of the undercut dovetail edge 24*c* of the adjoining bricks. If these surfaces do not line up, the brick is not properly seated into the formliner and must be reseated properly into the formliner to make the seals on the edge thereof with the brick as well as on the front face with the bottom surface 25 of the cementitious material effective as will be described hereinafter.

Figure 4:
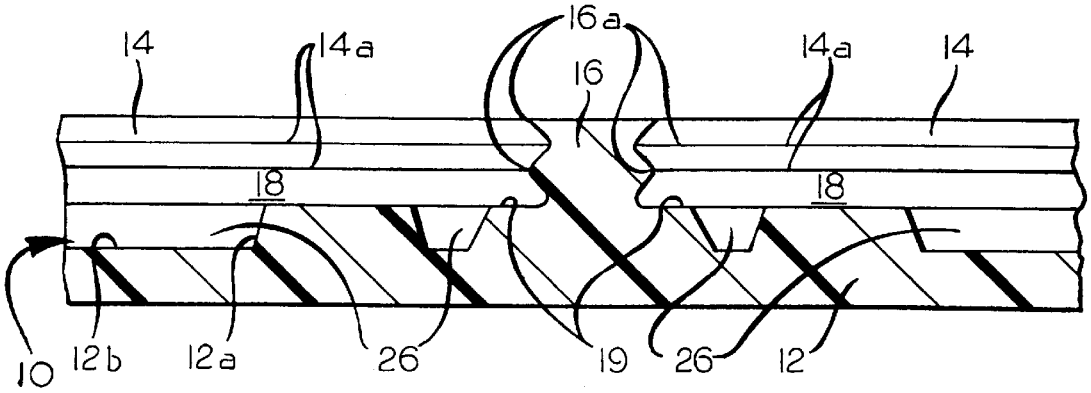
FIG. 4 is a sectional view, at an enlarged scale, taken on line 4—4 of FIG. 2.

The formliner 10 is preferably manufactured from an elastomeric material or any other appropriate material that can be readily and easily stripped away, after the decorative wall 20 has been formed therein and set. The formliner 10 is made up of a generally planar major layer 12 and a plurality the laterally aligned extending ribs 14 and transversely aligned extending ribs 16, as best shown in FIG. 4. The transverse ribs 16 and the lateral ribs 14 collectively define a plurality of recesses 18, each of which is sized and configured to snugly receive a correspondingly sized brick 24 therein.

Each of the lateral ribs 14 is provided with one or more inwardly projecting protrusions or ridges 14*a* that project therefrom into the interior of a respective recess 18 to securely engage and seal an adjacent surface of a respective brick 24, to prevent cementitious material from flowing into the interior of the recess 18. Likewise, each of the transverse ribs 16 is provided with a plurality of protrusions or ridges 16*a* that project therefrom into the interior of the respective, adjacent recess 18, to prevent cementitious material 22 from flowing into the recess 18 between the respective brick 24 and the adjacent transverse rib 16. It is preferred that more than one rib 14 or 16 be used. However, in the case of very thin bricks a person skilled in the art will easily recognize that the number of ribs or protrusions is a direct function of the thickness of the brick and, therefore, a single rib will accommodate the objectives of the described invention.

Figure 3:
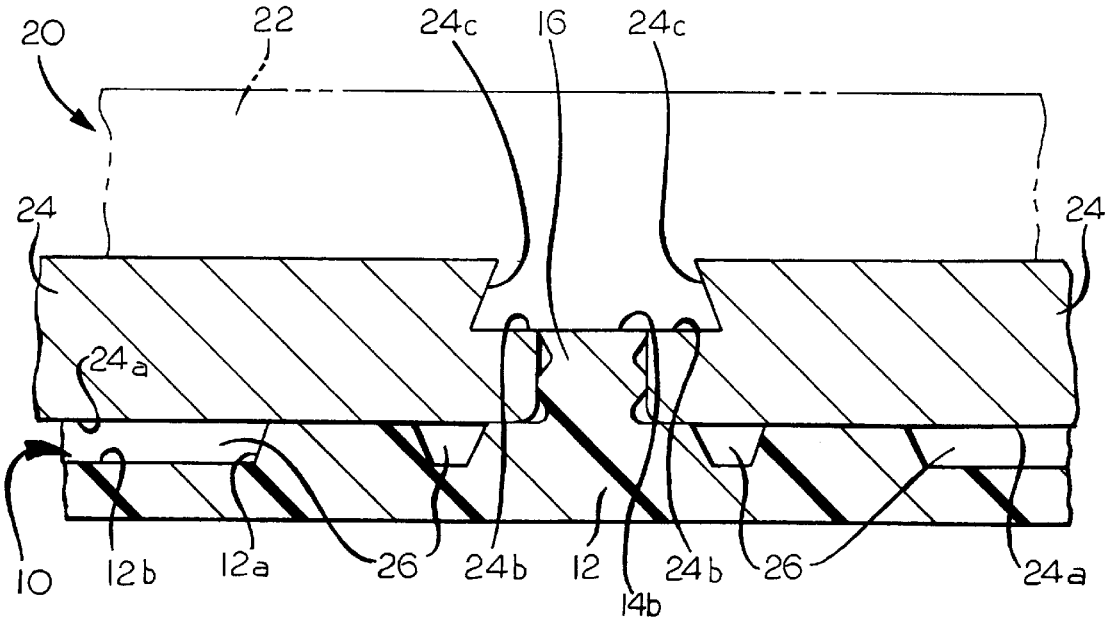
FIG. 3 is a sectional view, an enlarged scale, taken on lines 3—3 of FIG. 2.

If any cementitious material 22 does flow into a recess 18 as a result of irregularities in the space between a brick 24 and an adjacent lateral rib 14 or an adjacent transverse rib 16, notwithstanding the presence of the ridge 14*a* of the laterally extending rib 14 or the ridge 16*a* of the transverse rib 16, the cementitious material is blocked from contacting the front face 24*a* of a brick 24 within the recess 18 by providing a further seal surface 19 completely surrounding the edge of the front face 24*a* of the brick 24 as clearly shown in FIG. 1 and FIG. 3. As stated above, when the brick is properly mounted in the recess 18 of the formliner as evidenced by the upper surface 14*b* of the lateral and transverse ribs 14 and 16 being flush with the lower surface 24*b* of the undercut dovetail edge 24*c*, a secondary seal is created around the peripheral edge of the brick 24 along the edges of the front face 24*a* of the brick 24 firmly contacting the seal surface 19 in the recess 18. This seal prevents any cementitious material 22 from migrating out the entire front surface 24*a* of the brick 24.

Further defining the recess 18 is a plurality of spaced-apart upstanding pads 12*a* along the planar layer 12 of the formliner 10. The front face 24*a* of the brick 24 within the recess 18 rests upon the pads 12*a* once inserted in the recess 18. The pads or buttons 12*a* are strategically placed to provide a limit to the deflection of the brick 24 which will result from the load of the cementitious material 22 which will be poured upon it and which could also result due to workmen walking on the bricks as the bricks are inserted into the formliner. The pads or buttons 12*a* allow the brick to slightly deflect and also prevent excessive deflection as the mold is loaded. The pads or buttons 12*a* thereby prevent breakage of the brick due to the weight of the concrete poured into the mold. Sufficient pads 12*a* are provided to properly support the entire brick 24 as well as the weight of the superposed layer of cementitious material 22.

The pads 12*a* are preferably unitary with the layer 12 and extend an appropriate amount such that the transverse ribs 16 and lateral ribs 14 extend between neighboring bricks 24 to the upper surface 14*b* of the ribs 14 and 16. However, it is possible to use pads 12*a* which are made separate from the formliner 10 and then placed in the recess 18 and connected thereto.

The pads 12*a* further define a pocket 26 within the recess 18 between the front face 24*a* and a first upper surface portion 12*b* of the layer 12 of the formliner 10. Cementitious material 22 accumulating within the pocket 26, thus, will not be in contact with the front face 24*a* of a brick 24 within a recess 18, thereby eliminating or substantially simplifying the cleaning required of the front face 24*a* of the brick 24 upon the removal of the formliner 10 therefrom. The depth of the pocket 26 is controlled by the height of the pads 12*a*. Preferably, the pocket 26 is sufficiently deep to receive as much cementitious material as may possibly migrate past the protrusions or ridges 14*a* and 16*a* and the seal created along the edges of the front face 24*a* defined by the seal surface 19.

A further advantageous result of the invention is that the material of the brick 24 removed by the creation of the undercut dovetail edge 24*c* may be utilized to increase the thickness of the brick 24 thereby creating a greater surface area of the brick. By having more surface area of the brick embedded into the concrete a greater retention force is enabled. Therefore, for the same weight as the prior art brick it is possible to obtain a greater surface area of contact with the cementitious material resulting in greater retention of the brick by the cementitious material for the same unit weight as the prior art face brick.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

What is claimed is:

1. A formliner for use in supporting the front face of a plurality of spaced apart decorative bricks during the application of a cementitious material to the rear surfaces of said decorative bricks, said formliner comprising:

a generally planar layer having a first surface adapted to face the front faces of said plurality of spaced apart decorative bricks supported within said formliner;

a plurality of ribs extending in a direction away from said first surface and defining a plurality of brick receiving recesses within said formliner, each of said plurality of brick receiving recesses being adapted to receive a brick therein, each of said plurality of ribs extending a predetermined distance in a direction away from said first surface of said generally planar layer so as to define a space between the periphery of each of said bricks and each of said plurality of ribs when each brick is positioned in a respective one of said plurality of brick receiving recesses;

at least one resilient ridge extending inwardly from each of said plurality of ribs into said defined space to communicate with each of said bricks, such that as said at least one resilient ridge extends inwardly into each of said plurality of brick receiving recesses when each of said bricks is mounted within each of said plurality of brick receiving recesses, a seal is created to prevent cementitious material from flowing towards the front face of each said brick located within each of said plurality of brick receiving recesses;

a cavity in each of said plurality of brick receiving recesses, said cavity having a bottom surface; and at least one pad located within each cavity in said plurality of brick receiving recesses, said at least one pad extending from said bottom surface of each said cavity in a direction towards said first surface said at least one pad of each said plurality of brick receiving recesses defining at least one pocket surrounding said at least one pad and complementary with said bottom surface of said cavity to allow any cementitious material flowing past said seal to collect in said cavity and thereby prevent cementitious material from contacting the front face of each said brick once located within said plurality of brick receiving recesses.

2. A formliner according to claim 1 wherein said plurality of ribs comprises:

a plurality of laterally aligned ribs extending from said generally planar layer; and a plurality of transversely aligned ribs extending from said generally planar layer, said plurality of lateral ribs and said plurality of transverse ribs defining said plurality of brick receiving recesses.

3. A formliner according to claim 2 wherein said at least one resilient ridge comprises a plurality of resilient ridges.

4. A formliner according to claim 2 wherein each rib of said plurality of transversely extending ribs and said plurality of laterally aligned ribs comprises said at least one resilient ridge extending inwardly therefrom into a respective recess of said plurality of brick receiving recesses for engaging a surface of a brick once located in said respective recess, said at least one resilient ridge preventing cementitious material from flowing between said brick and said plurality of transverse and laterally aligned ribs toward the front face of said brick.

5. A formliner according to claim 4 wherein each said rib of said plurality of transversely extending ribs and said plurality of laterally aligned ribs comprises a plurality of ridges extending therefrom for engaging a surface of a brick once located in said recess.

6. A formliner for use in supporting the front face of a plurality of spaced apart decorative bricks during the application of a cementitious material to the rear surfaces of said decorative bricks, said formliner comprising:

a generally planar layer having a first surface adapted to face the front faces of said plurality of decorative bricks supported within said formliner;

a plurality of ribs extending in a direction away from said first surface and defining a plurality of brick receiving recesses within said formliner, each of said plurality of brick receiving recesses being adapted to receive a brick therein, each said plurality of ribs extending a predetermined distance in a direction away from said first surface of said generally planar layer so as to define a space between the periphery of said bricks and each of said plurality of ribs when each brick is positioned in a respective one of said plurality of brick receiving recesses;

at least one resilient ridge extending inwardly from each of said plurality of ribs into said defined space to communicate with each of said bricks, such that as said at least one resilient ridge extends inwardly into each of said plurality of brick receiving recesses when each of said bricks is mounted within each of said recesses, a seal is created to prevent cementitious material from flowing towards the front face of each of said bricks located within each of said brick receiving recesses;

a cavity defining each of said plurality of brick receiving recesses, said cavity having said first surface at one end thereof; and at least one pad located within each cavity in said plurality of brick receiving recesses, said at least one pad having one end integral with said first surface of each said cavity and extending in a direction away from said first surface, said at least one pad within each cavity in said plurality of brick receiving recesses defining at least one pocket surrounding said at least one pad to allow any cementitious material flowing past said sealing surface to collect in said pocket and thereby prevent cementitious material from contacting the front face of the brick once located within said recess.

* * * * *

UNITED STATES PATENT AND TRADEMARK OFFICE

CERTIFICATE OF CORRECTION

PATENT NO 6,041,567

DATED March 28, 2000

INVENTOR(S) Passeno

Sheet 1 of 2

It is certified that error appears in the above-identified patent and that said Letters Patent are hereby corrected as shown below:

Column 1, line 47, delete "masonary" and insert ----masonry----.

Column 1, line 57, delete "the" and insert ----to----.

Column 3, line 34, after "view," insert ----at----.

Column 3, line 67, after "that" insert ----a bottom surface 25 of the----.

Column 4, line 22, delete "bottom surface 25 of the cementitious material" and insert ----bottom or seal surface 19----.

Column 4, line 29, after "plurality" insert ----of----.

Column 4, line 58, delete "a" and insert ----the----.

Column 4, line 60, delete "FIG. 1 and FIG. 3" and insert ----FIG. 4----.

UNITED STATES PATENT AND TRADEMARK OFFICE
CERTIFICATE OF CORRECTION

PATENT NO 6,041,567 Sheet 2 of 2

DATED March 28, 2000

INVENTOR(S) Passeno

It is certified that error appears in the above-identified patent and that said Letters Patent are hereby corrected as shown below:

Column 5, line 19, before "layer" insert ----planar----.

Column 6, line 25, after "surface" insert a comma ----,----.

Column 6, line 52, delete "transverse" and insert ----transversely----.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*